United States Patent [19]

Shipman

[11] 4,345,343

[45] Aug. 24, 1982

[54] APPARATUS FOR THE CLEANING AND SANITATION OF A RESTROOM OR LAVORATORY

[76] Inventor: Matthew W. Shipman, 300 S. Westgate Ave., Los Angeles, Calif. 90049

[21] Appl. No.: 183,262

[22] Filed: Sep. 2, 1980

[51] Int. Cl.[3] ..... A47K 4/00

[52] U.S. Cl. ..... 4/662; 4/661; 134/100

[58] Field of Search ..... 4/662, 191, 654, 615, 4/616, 209, 213, 218, 347, 192, 661; 134/100, 166 R, 167 R, 169 R, 172; 222/144.5, 145, 630; 15/24, 28, 29

[56] References Cited

U.S. PATENT DOCUMENTS

| | | | |
|---|---|---|---|
| 3,361,300 | 1/1968 | Kaplan | 222/133 |
| 3,742,520 | 7/1973 | Bernardi | 4/662 |
| 3,747,129 | 7/1973 | Dyar | 4/662 |
| 3,755,826 | 9/1973 | Roberts | 4/662 |
| 3,810,787 | 5/1974 | Yoeli et al. | 134/172 X |
| 3,837,011 | 9/1974 | McTighe et al. | 4/662 |
| 3,869,732 | 3/1975 | Garvey et al. | 4/662 |
| 3,969,133 | 7/1976 | McTighe et al. | 134/21 |

*Primary Examiner*—Henry K. Artis
*Attorney, Agent, or Firm*—Lyon & Lyon

[57] ABSTRACT

A public restroom or lavoratory is automatically cleansed and sanitized by using a shaft with a nozzle thereon wherein the shaft is integral with a mixing chamber having multiple feed lines. A control unit by actuating the feed lines provides the ability to spray through the nozzle either hot water or hot water containing a cleansing solution. Other cleaning implements are provided within a wall supported unit which also houses the mixing chamber, feed lines, and control unit components.

10 Claims, 3 Drawing Figures

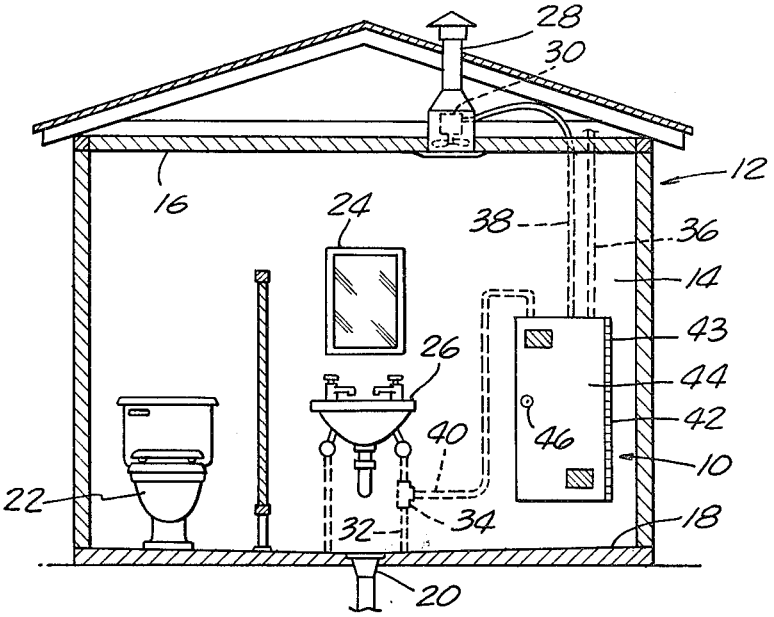
FIG. 1.
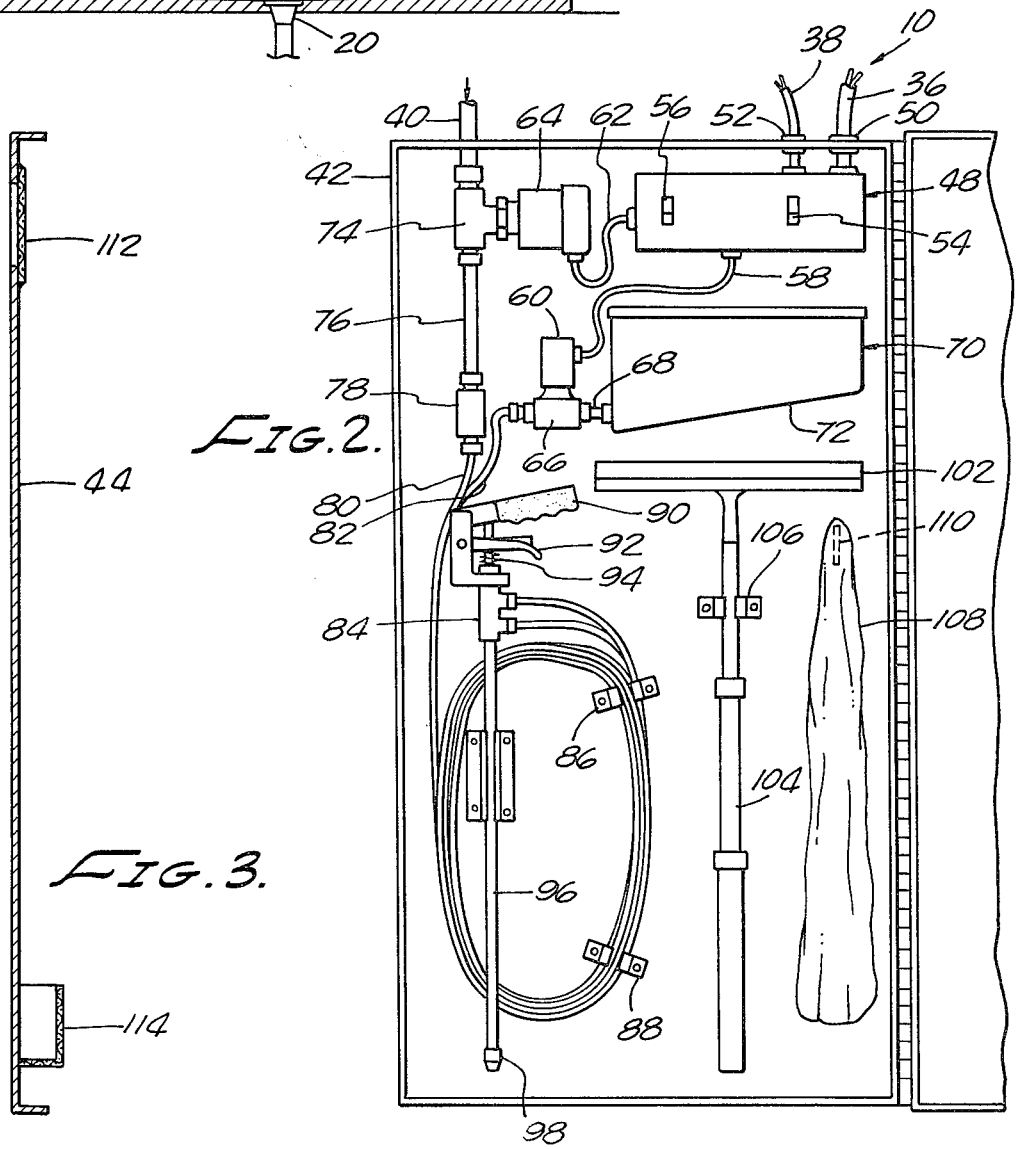
FIG. 2.
FIG. 3.

APPARATUS FOR THE CLEANING AND SANITATION OF A RESTROOM OR LAVORATORY

BACKGROUND OF THE INVENTION

The present invention relates generally to the cleaning and sanitizing of public restrooms and lavoratories, and more particularly to an apparatus for efficiently and automatically cleansing said facilities.

Most commercial establishments provide for the convenience of their customers a restroom on the premises. This is particularly true in the case of service stations and eating establishments, wherein patrons may require the use of a restroom while utilizing other services of the particular business.

As with any restaurant facility, the aesthetics of the particular location are normally requisite to experiencing continued customer loyalty. A customer perceiving a filthy or apparently unsanitary washing facility will in many cases refrain from patronizing the establishment, thus causing a loss in business. Moreover, the cleanliness may affect the reputation of the establishment which is extremely difficult to change after the public has become aware of certain problems including cleanliness. This poor public acceptance of unsanitary and filthy restrooms has required owners of these establishments to implement cleaning schedules and techniques far more frequently than previously utilized.

Similarly, with service or repair stations, an unsanitary washroom facility may also have a direct effect on customer loyalty. Owners of these types of establishments have a continuous problem in keeping the washroom facilities in a clean and sanitary condition, primarily because of the frequent use and abuse of those facilities by transients as well as patrons. Moreover, in the case of service stations, where field representatives of the supplier continuously check the service stations' facilities, including their restroom, because those stations represent the tradename of the supplier, the owner of the service station is subject to severe scrutiny and possibly the loss of a license for maintaining an establishment that does not meet the requisite cleanliness standards of the parent company. Because it is impossible to monitor public use of the washroom facilities, a far more realistic approach is to provide a method and apparatus for rapidly cleaning these facilities on a more frequent basis than previously existed.

Due to the cost of manual labor to perform these types of activities, it becomes economically prohibitive to use maintenance personnel on a continuing basis for these stated purposes. Since many of these types of establishments, only have one or two employees, the problem of cleansing these facilities and the time required to perform the same may seriously affect the operation of the service station.

As shown in U.S. Pat. No. 3,969,133, attempts have been made to provide restroom facilities which may be automatically cleaned. However, the expense and renovation required to implement these systems is in many cases impractical.

SUMMARY OF THE INVENTION

The invention of the present application solves many of the problems present in the previous attempts to solve restroom uncleanliness.

Briefly, a washroom facility of the type aforementioned has a sink, a commode, and a rack for storing paper towels or the like. In certain types of facilities, there may also be present mirrors, hot air hand dryers and vanities of some form or nature, all this depending upon the aesthetics that the owner may wish to incorporate within the restroom facility. Normally, there is present some space along one of the sidewalls for the incorporation of a housing with the elements of the present invention contained therein.

The housing may either be externally attached to a side wall, or may be integrally contained within the side wall by affixing it between wall support structures such as studs. A door having multiple vents is movably attached to the outwardly extending portion of the housing and is provided with a locking mechanism. When the door is opened, access is possible to a spray gun which is attached to a flexible hose suspended from a hot water coupler. A hot water feedline is attached to the hot water pipe of the sink facility provided within the restroom or directly to the main hot water feed into the restroom. A solenoid valve operates to open or shut the hot water feedline thereby permitting hot water to pass into the hot water coupler and eventually out of the spray gun. A second solenoid is disposed between a soap receptacle containing a cleaning solution and a soap line which extends with the hot water line to a mixing chamber integral with the spray gun. This solenoid provides for the feeding of soapy detergent into the mixing chamber and then out of the spray gun. The tank containing the cleaning solution is located at an inclined angle superior to the mixing chamber whereby gravity provides the force for the travel of the cleaning solution into the mixing chamber. The solenoids are operated by pushbutton switches located within a control panel inside the aforementioned housing.

The spray gun has an elongated rod member and nozzle which provides for cleansing in otherwise difficult to reach areas. Also located within the housing are a cleaning type cloth for removing the residual detergent solutions or water after they have been sprayed upon the interior walls and components of the restroom facility. A squeegee device and other cleaning implements may also be contained within the housing.

To utilize the apparatus and method of the present invention, the restroom is closed off from the remainder of the commercial establishment by closing the door or drawing a screen over the opening. The attendant then removes all paper and solid waste from the floor prior to using the spray gun. The metal housing is opened and the spray gun is removed therefrom. The attendant then initiates the cycle by depressing the switch within the control panel marked SOAP while simultaneously pressing the control button marked CLEAR WATER or HOT WATER. In this manner he is able to impart a soapy solution to the interior surfaces of the restroom facility. By utilizing an extended rod the entire inside of the facility may be cleansed rapidly yet thoroughly including the ceiling. After the restroom has been rinsed with the hot soapy water, the attendant depresses the soap button thereby shutting off the entry of soapy solution into the mixing chamber, and once again washes the interior of the restroom facility, this time with only clear hot water. When complete, the attendant places the spray gun into the self-contained housing and removes the cloth and the squeegee device. He then squeegees the walls, ceiling, and floor of the restroom facility and moves the fluid toward a drain located in the lowermost portion of the floor of the facility. After completion of this step, the squeegee is placed back into the metal housing and a mop or a chamois type cloth is removed. The attendant then wipes down all of the fixtures and/or mirrors located within the restroom facility and places those implements back into the housing.

Automatic shut-off circuitry may be provided for within the control unit whereby the hot spray water may only be used for a predetermined period of time. Similarly, within the control unit, circuitry may be provided for increasing the ventilation capability of the restroom facility thereby removing any steam from the restroom facility sooner than normal conditions would permit.

By utilizing this apparatus and procedure, the restroom is cleaned within a very short period of time and ready for further use by the patrons of the establishment. Because this cleaning is performed in such a rapid and efficient manner, the owner or attendant is required to take only very few minutes from the business day to assure a properly sanitized and clean restroom facility, thereby contributing to the aesthetics of his establishment the comfort of his customers and the repatronization of his establishment.

It is therefore a principal object of the present invention to provide a method and apparatus for cleaning a restroom or lavoratory facility wherein the elements to accomplish said cleaning are present at all times within the restroom facility.

It is another object of the present invention to provide a method and apparatus which enables cleaning with either a soapy solution or clean water while utilizing only one cleaning implement with a mixing chamber integral therewith.

It is another object of the present invention to provide a cleaning method and apparatus adapted to increase the ventilation system thus further reducing the amount of time required to adequately clean the facility.

Other objects and advantages to the present invention will become readily apparent from the following description taking together with the accompanying drawings, wherein:

DESCRIPTION OF THE DRAWINGS

FIG. 1 is a perspective view of the cleaning apparatus of the present invention as present in a restroom facility.

FIG. 2 is a magnified view of a portion of the apparatus of the present invention.

FIG. 3 is a side view of the door of the present invention illustrating its venting and deodorant holding capability.

DESCRIPTION OF THE PREFERRED EMBODIMENT

A restroom cleansing apparatus constructed in accordance with one embodiment of the present invention is indicated generally by the reference numeral 10 in FIGS. 1 and 2.

As shown in FIG. 1, a standard restroom facility 12 has multiple sidewalls 14 with a ceiling 16 integral therewith. The surfaces inside the restroom are normally composed of a non-porous material and are adapted to be cleansed by water soluble soaps of the type mentioned herein. Extending between the sidewalls 14 is a floor 18 which has a gradual slope from the opposing sidewalls 14 downwardly toward the drainage system 20. The drainage system 20 is normally located substantially in the center of the restroom facility 12 but may be located in other areas depending upon the desired aesthetics of the restroom facility 12. It should also be noted that although the floor 18 of the restroom facility 12 is shown to gradually slope toward the center of the restroom facility 12 other placements of the drainage system 20 may require that the floor 18 slope in other manners and directions.

Also located within the restroom facility 12 are a commode 22, mirror 24 and sink 26 each of which is of a conventional nature. Located within the ceiling 16 of the restroom facility 12 is an exhaust system 28 which has at the lower end thereof a fan 30 which is adapted to remove water vapor or the like from the facility 12. The exhaust fan 30 may be located at other areas in the facility 12, such as within the sidewalls 14, without departing from the spirit of the invention. Entering the facility 12 is a main hot water line 32 which simultaneously feeds the sink 26 and the restroom cleaning apparatus 10 through the use of a T-connector 34. Although in the preferred embodiment the main hot water line 32 is shown to enter the T-connector 34, it should be apparent that the independent hot water feed capability may be provided to the cleansing apparatus 10.

A main electric line 36 may be mounted within the sidewalls 14 or may, if properly insulated, enter externally from the electric supply to the cleaning apparatus 10. There may also be present a fan lead 38 extending outwardly from the cleaning apparatus 10 and adapted to control the exhaust fan 30 from the cleaning apparatus 10. Lastly, integral with the T-connector 34 is a hot water feed line 40 which provides hot water to the apparatus 10. It should be noted that although the present invention is shown to utilize hot water for cleansing and rinsing functions, suitable connections could also be made to cold water lines. The present invention is shown to use hot water because of solubility differences between hot and cold water when utilizing certain detergents.

As shown in FIG. 1, a restroom cleaning apparatus 10 is shown disposed along one of the sidewalls 14 in a manner that provides easy access for attendants or other cleaning personnel. The cleaning apparatus 10 has a housing 42 which may be supported by conventional means along the outside of the sidewall 14 or may be fixedly supported within the sidewall 14 between supporting studs (now shown). Means are provided, such as hinges 43 to provide movable attachment of a door 44 to the housing 42 wherein the door 44 has integral therewith a locking mechanism 46. Other features of the door 44 will be discussed in the description accompanying FIG. 3.

An enlarged view of the cleaning apparatus 10 of the present invention is shown in FIG. 2. Briefly, the housing 42 has supported therein an electrical control unit 46 into which the main electric line 36 enters through a first sealed aperture 50. When the cleansing apparatus 10 is adapted to independently control the exhaust fan 30 a fan lead 38 also extends from the control unit 44 through a second sealed aperture 52. Due to the presence of the cleansing solution and water spray at various times during the cleaning process, it is recommended that these apertures 50 and 52 be completely sealed. Along the face of a control unit 48 an integral therewith are convention switches which may be of various types but which are adapted to provide on/off operation of the electrical components of the present invention. A soap switch 54 initiates and terminates the imposition of a soapy solution to the cleaning elements of the present invention. A hot water switch 56 either initiates or terminates the flow of water into the cleaning elements of the present invention. Although in the preferred embodiment the switches 54 and 56 are shown to be of the normal wall type, it should be apparent that micro-switches or other more elaborate switches may be provided.

Passing from the control unit 48 in a generally downward direction is a soap solenoid lead 58 which carries current to the soap solenoid 60 when the soap switch 54 is in the "on" position. A hot water lead 62 is also integral with the control unit 48 and is adapted to carry current to a hot water solenoid 64 when the hot water switch 56 is in the "on" position. Integrally connected to the soap solenoid 60 is a soap valve 66 which works with the solenoid 60 to provide cleaning solution to the cleaning elements. A soap feed line 68 extends between the valve 66 and a soap receptacle 70 which has a gradually sloping bottom section 72 to assure uniform movement of soapy solution into the cleaning elements. Although not shown, in the preferred embodiment there may also be present a soap pumping means to assure the movement of soap supply during stages of the cleaning process.

Integral with the hot water solenoid 64 is a hot water valve 74 which when open allows hot water communication to the cleaning elements. Projecting downwardly but integral with the valve 74 is a directing water line 76 which terminates at a coupler 78. The directing line 76 is shown to be uniform in cross-section, however, it may be desirable to have the line 76 taper to a smaller cross-sectional area at the coupler. This tapering effect will cause an increase in water pressure so as to effect greater cleaning capability. It should also be noted that all fluid lines are connected to their respective couplers or valves or solenoids in a sealed relationship.

A flexible hot water hose 80 is integral with the coupler 78 and may be made of rubber or other conventional materials impervious to water temperatures less than 150°. A similarly flexible soap hose 82 is connected to the soap valve 56 and is adapted to carry the soapy solution present within the receptacle 70. The hoses 80 and 82 may be connected together by clamps, glue or other conventional means to assure ease of operation of the cleaning elements. Both hoses 80 and 82 terminate at a mixing chamber 84 which provides for the dilution by water of the soaping solution present within the receptacle 70 described herein. It should be noted that suitable clamps 86 and 88 may be provided to suspend the hoses 80 and 82 within the housing 42 when the cleaning process is not being performed.

Ridgedly secured to the mixing chamber 84 is a handle 90 which has a trigger 92 pivotably secured thereto. A plunger 94 is secured to the trigger 92 wherein movement of the plunger 94 will cause either hot water or soapy solution to pass out of the mixing chamber 84. A spring means (not shown) may be provided between the trigger 92 and handle 90 to occasion non-effluence of soapy solution and water when the cleaning elements are not in use. Integrally connected with the mixing chamber 84 is a cleaning rod 96 which is preferably made of either metal or hardened plastic. The rod 96 has an exit nozzle 98 at its most distal end, wherein the exit nozzle 98 may be of various configurations to facilitate a more radially projecting dispersal of the cleansing solution or hot water. Supporting the rod 96 is a clamp 100 which is ridgedly connected to the housing 42.

Also disposed within the housing 42 is a squeegee 102 with a telescopic pole 104 thus permitting diverse use of the squeegee 102 in otherwise hard to reach areas. A clamp 106 integral with the housing 42 supports the pole 104 in a substantially vertical position. Present within the housing 42 is also a chamois or cloth 108 which is suspended from a pin 110 fixedly secured to the housing 42.

In FIG. 3, the door 44 is shown in cross-section. In the uppermost portion of the door 44 is a vent 112 which is adapted to permit accumulated water vapor to pass from the housing 42 when the door 44 is closed. Also integral with the door 44 is a deodorant rack 114 wherein aromatic substances may be placed to occasion fresh smelling air with the restroom facility 12. The odors resultant from the aromatic substance will pass through the vent 112 with the accumulated water vapor.

The operation of the present invention will now be briefly described. Upon opening the door 44 the attendant removes the handle 90 and hoses 80 and 82. As a next step the hot water switch is turned to an "on" position to occasion passages of hot water through the valve 74, the hose 80 and into the mixing chamber 84. The attendant then depresses the soap switch 54 to occasion passage of soapy solution through the valve 66, hose 82 and into the mixing chamber 84. By pressing the trigger 92, the soapy solution will be mixed into the hot water in the mixing chamber 84 and the resulting mixture will pass out of the rod 96. The attendant may direct the mixture to the ceiling, walls or floor to effect cleaning of these surfaces. After an appropriate period of time the soap switch is turned to the "off" position and the restroom facility 12 is rinsed with the clear hot water. After rinsing has been completed the attendant turns the hot water switch "off" thus terminating passage of hot water from the rod 96. The attendant then places the hoses 80 and 82 and rod 96 back into the housing 42 and removes the squeegee 102 and chamois 108. By using the telescopic pole 104 attached to the squeegee 102 the entire restroom may be cleared of water. Any residual water or soapy solution is then removed by the chamois 108. The remainder of the cleaning process is thus completed.

Although not incorporated into the preferred embodiment, there may be provided timing electronics to effectuate dispersal of the soapy solution for only a certain period of time. Similarly, circuitry may also be provided to cause increased fan 30 performance for a period of time during or after use of the cleaning apparatus 10. Lastly, although the housing 42 is preferably made of metal it may also be formed of suitable plastics.

While I have illustrated and described the preferred embodiment of my invention in some detail, it is to be understood that the embodiment is capable of variation and modification, and I therefore do not wish to be limited to the precise details set forth herein but desire to avail myself of such changes and modifications as fall within the scope of the following claims.

I claim:

1. An apparatus for cleaning and sanitizing a restroom facility having multiple sidewalls and a water line inside the restroom facility, the apparatus comprising, a retrofitable housing, means for securing said housing to at least one of said sidewalls of said restroom facility, means for storing a cleaning solution, said storing means suspended within said housing, first means for controlling water flow from said water line inside said restroom facility into said housing, second means for controlling cleaning solution flow from said storing means, said first and second controlling means contained within said housing, a spray gun flexibly attached to said housing, a mixing chamber adapted to receive said water flow and said cleaning solution flow, said mixing chamber disposed within said housing, said mixing chamber further adapted to direct said water flow and cleaning solution flow to said spray gun.

2. The apparatus of claim 1, which includes a means for increasing ventilation in said restroom facility, said increasing means disposed within said housing.

3. The apparatus of claim 1, wherein said first controlling means comprises a solenoid, a valve, said solenoid adapted to permit or terminate flow of water through said valve into said mixing chamber.

4. The apparatus of claim 1, wherein said second controlling means comprises a solenoid, a valve, said solenoid adapted to permit or terminate flow of cleaning solution through said value into said mixing chamber.

5. The apparatus of claim 1, wherein said means for storing a cleaning solution is operative to provide steady flow of said cleaning solution into said mixing chamber independent of spray gun position.

6. The apparatus of claim 1, which includes a means for removing water from said sidewalls of said restroom facility, said removing means adapted to fit within said housing.

7. An apparatus for cleaning a room, said room having multiple walls, said room having a water flow line disposed therein, the apparatus comprising, a retrofitable housing adapted to be secured to at least one of said sidewalls, means for controlling water flow into said housing, said controlling means contained within said housing, a receptacle for holding a cleaning solution, said receptacle suspended within said housing, means for regulating cleaning solution flow, said regulating means contained within said housing, means for mixing said water flow and said cleaning solution flow, said mixing means disposed within said housing, spray gun means adapted to direct only water flow onto said walls, said spray gun means operative to also direct said water flow and cleaning solution onto said walls, said spray gun means movably secured to said housing, said spray gun means having means for controlling dispersal of said water flow and said cleaning solution.

8. The apparatus of claim 7, which includes a means for increasing ventilation within said room, said increasing means disposed within said housing.

9. The apparatus of claim 7, wherein said controlling means comprises a solenoid, a valve, said solenoid operative to permit water flow through said valve into said mixing means.

10. The apparatus of claim 9, wherein said regulating means comprises a regulator solenoid, a regulator valve, said regulator solenoid operative to permit cleaning solution to flow through said regulator valve into said mixing chamber.

* * * * *